US008210252B2

(12) United States Patent
Martin et al.

(10) Patent No.: US 8,210,252 B2
(45) **Date of Patent: *Jul. 3, 2012**

(54) FIBER OPTIC GRAVEL DISTRIBUTION POSITION SENSOR SYSTEM

(75) Inventors: Carl S. Martin, Houston, TX (US); Carl W. Stoesz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 288 days.

This patent is subject to a terminal disclaimer.

(21) Appl. No.: 12/543,634

(22) Filed: Aug. 19, 2009

(65) Prior Publication Data

US 2011/0042061 A1 Feb. 24, 2011

(51) Int. Cl.
*E21B 43/04* (2006.01)

(52) U.S. Cl. ..... 166/66; 166/227; 166/51

(58) Field of Classification Search ..... 166/51, 166/66, 227, 250.01, 278
See application file for complete search history.

(56) References Cited

U.S. PATENT DOCUMENTS

| | | | | |
|---|---|---|---|---|
| 5,294,923 | A | 3/1994 | Juergens et al. | |
| 6,409,219 | B1 | 6/2002 | Broome et al. | |
| 6,439,932 | B1 | 8/2002 | Ripolone | |
| 6,554,064 | B1 | 4/2003 | Restarick et al. | |
| 6,755,253 | B2 | 6/2004 | Smith et al. | |
| 6,776,636 | B1 | 8/2004 | Cameron et al. | |
| 7,104,331 | B2 | 9/2006 | Bussear et al. | |
| 7,165,892 | B2 | 1/2007 | Grigsby et al. | |
| 7,191,832 | B2 | 3/2007 | Grigsby et al. | |
| 7,222,676 | B2 * | 5/2007 | Patel et al. | 166/378 |
| 7,441,605 | B2 | 10/2008 | Coronado et al. | |
| 7,475,734 | B2 | 1/2009 | O'Malley et al. | |
| 7,478,830 | B2 | 1/2009 | Weigand et al. | |
| 7,509,000 | B2 | 3/2009 | Coronado | |
| 2002/0007948 | A1 | 1/2002 | Bayne et al. | |
| 2005/0074210 | A1 | 4/2005 | Grigsby et al. | |
| 2008/0047703 | A1 | 2/2008 | Stoesz et al. | |
| 2008/0078556 | A1 | 4/2008 | Stoesz et al. | |
| 2008/0264631 | A1 | 10/2008 | Mendez et al. | |

* cited by examiner

*Primary Examiner* — Nicole Coy
(74) *Attorney, Agent, or Firm* — Steve Rosenblatt

(57) ABSTRACT

The well condition during gravel packing is monitored and the gravel distribution condition is sent to the surface in real time through the preferred technique of a fiber optic line that wraps around the screens directly or indirectly on a surrounding tube around the screens. The fiber optic line has a breakaway connection that severs when the completion inner string is removed. A production string can then be run in to tag the fiber optic line through a wet connect to continue monitoring well conditions in the production phase. The fiber optic line can also be coiled above the packer so that relative movement of the inner string to the set packer can be detected and communicated to the surface in real time so as to know that the crossover has been moved the proper distance to, for example, get it from the gravel packing position to the reverse out position.

18 Claims, 1 Drawing Sheet

10
20
37
36
14
22
12
38
28
44
36
18
24
26
16
36
44
40
42
30
32
28
32
34

FIBER OPTIC GRAVEL DISTRIBUTION POSITION SENSOR SYSTEM

FIELD OF THE INVENTION

The field of the invention relates to the use of local sensors during completions to monitor gravel packing and to enable surface personnel to accurately know how much movement has occurred at a bottom hole assembly far underground when the completion tool needs repositioning such as going from gravel deposition to reversing out excess gravel.

BACKGROUND OF THE INVENTION

A completion using screens and a zonal isolation packer typically involves a screen assembly supported by the packer with a lateral exit between the packer and the screens for the gravel. The exiting gravel fills the annular space outside the screens while returns typically enter the screens and come into an inner string assembly that extends from the surface and through the packer to the vicinity of the screen. This inner string assembly typically has a setting tool for the packer and a crossover tool leading to a wash pipe that extends within the screen assembly. The inner string assembly is manipulated from the surface to place the crossover tool in different positions. Typically flow down the inner string can be directed into the formation for a fracturing job with the crossover tool in a position where no returns to the surface are possible. The crossover tool can be repositioned to allow gravel slurry to go down the inner string and cross over to exit out into the lower annulus below the already set packer with the carrier fluid going through the wash pipe and back through a different path in the crossover to the upper annulus above the set packer and up to the surface. After the gravel is deposited, the crossover tool is typically picked up about a meter and the remaining gravel slurry can be reversed out through clean fluid pumped down the upper annulus and into a port now in communication with the tubing that is above the packer as a result of raising the crossover.

One of the issues with gravel packing is whether the gravel distributes evenly. The gravel slurry can bridge in localized areas and cause a void around the screens that is not filled with gravel. Various techniques have been employed to prevent bridging and most involve the provision of tubes that run along the screens externally or internally in some designs that allow the gravel slurry to bypass a bridge and continue filling the annular space. These tubes are sometimes called shunt tubes because of their purpose. One example of this design is in U.S. Pat. No. 6,409,219. Fiber optic lines have been wrapped around screens but remain inactive during gravel packing. In the past these fiber optic lines are either connected to the surface when a production string tags the set packer after gravel packing when a downhole connection is made up. The downhole connection is known as a wet connect and it brings the other part of the connection to the packer so that when the production string is made up to the packer the wet connect can put the extension portion of the fiber optic line that is run along the production string in communication with the balance of the fiber optic line that was initially installed around the screen. An alternate way to do this is to connect auxiliary conduits with a wet connection and after that connection is made to pump a fiber optic cable through the conduit system that now has a portion below the packer and in the producing zone and another portion going up the side of the production tubing to the surface from the other portion of the wet connection that is delivered with the production string when tagged into the production packer. Some examples of systems that use wet connections or fiber optic lines in the ways mentioned above are U.S. Pat. Nos. 7,441,605; 7,509,000; 7,478,830; 7,475,734; 6,776,636; 6,755,253; 6,439,932; 5,294,923; US Publication 20080047703 and 20080078556.

What is needed and provided by the present invention is a way to sense the well condition during gravel packing in real time at the surface to monitor the effectiveness of the gravel pack as it occurs. This is accomplished using a sensing device that is preferably a fiber optic line that is wound around the screen assembly and passed through the packer and continued along the inner string as it is initially assembled. After the gravel pack is completed and the inner string is removed, the fiber optic line is severed preferably at a pre-designated break away connection that is sealed. The production string is then run in and using a wet connect can re-obtain the same or a discrete fiber optic line to allow monitoring to continue during production. Another aspect of the invention is the provision of a sensor. Preferably a fiber optic line is secured to the set packer at one location and can sense the relative movement of the inner string with respect to the packer. This allows for a localized measurement of the movement required downhole to get the crossover tool into its various positions without surface personnel having to guess and compensate for weight and thermal effects to determine how much surface movement will be required to get the desired movement with respect to the set packer. The present invention allows the fiber optic line to sense the relative movement in the form of stress applied to the line at various locations so as to give a real time indication at the surface that the crossover has been properly repositioned. The specific techniques of employing the fiber optic line in detecting relative movement that were disclosed in U.S. Pat. No. 7,104,331 are incorporated by reference herein as if fully set forth.

These and other aspects of the present invention will be more readily apparent to those skilled in the art from a review of the description of the preferred embodiment and the associated drawings while recognizing that the full scope of the invention is to be found in the appended claims.

SUMMARY OF THE INVENTION

The well condition during gravel packing is monitored and the gravel distribution condition is sent to the surface in real time through the preferred technique of a fiber optic line that wraps around the screens directly or indirectly on a surrounding tube around the screens. The fiber optic line has a breakaway connection that severs when the completion inner string is removed. A production string can then be run in to tag the same or a discrete fiber optic line through a wet connect to continue monitoring well conditions in the production phase. The fiber optic line can also be coiled above the packer so that relative movement of the inner string to the set packer can be detected and communicated to the surface in real time so as to know that the crossover has been moved the proper distance to, for example, get it from the gravel packing position to the reverse out position.

DETAILED DESCRIPTION OF THE PREFERRED EMBODIMENT

Figures 1, 2, 3, 4, 5, 6:
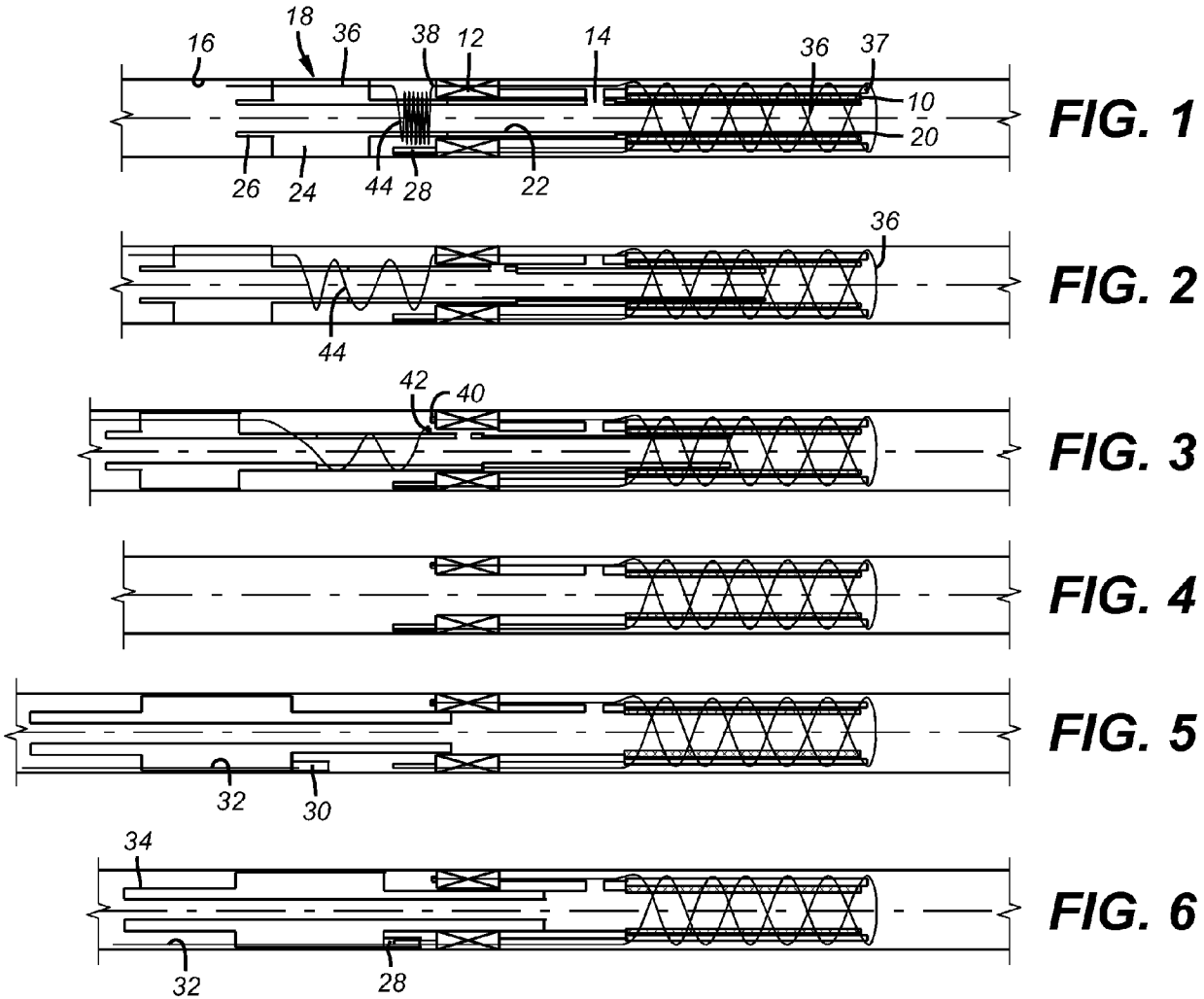
FIG. 1 is a run in position of a completion assembly showing the fiber optic line above and below the packer.
FIG. 2 is the view of FIG. 1 showing the inner string shifted with respect to the packer which stretches out the fiber optic above the packer.
FIG. 3 is the view of FIG. 2 showing enough movement of the inner string to sever the fiber optic cable at a predetermined location.
FIG. 4 is the view of FIG. 3 showing the inner completion string removed along with the fiber optic line segment that was secured to it and located above the sever location.
FIG. 5 is the view of FIG. 4 showing the production string running in with another segment of the fiber optic line attached to it and a wet connect not yet having been made up.
FIG. 6 is the view of FIG. 5 with the wet connect made up and the fiber optic line in condition to monitor the well on production and send data to the surface in real time.

FIGS. 1-6 are schematic representations of a completion assembly having the basic components described above. Most of the major components are illustrated to provide context for an understanding of the invention. There is a screen assembly 10 supported by a packer 12 with a gravel exit port 14 in between. The wellbore 16 also shows an inner string assembly 18 that starts at a lower end with a wash pipe 20 and has a crossover 22 and a packer setting tool 24 further uphole. String 26 extends to the surface.

Packer 12 has a wet connect connection portion 28 that looks uphole and ultimately receives portion 30 of the wet connection that is attached to the production string 34 (see FIGS. 5 and 6). A fiber optic line 32 extends along the production string 34 and when connection components 28 and 30 make up as the production string 34 is tagged into the packer 12, there is re-established a connection from the surface to the fiber optic line 36 shown spirally wrapped around an optional outer tube 38 mounted over the screen assembly 10. While a single fiber optic line can be used around the screen assembly 10 doing so will also require an optical splitter as part of the wet connection portion 28. Optionally, a second fiber optic line (not shown) can be used to go around the screen assembly 10 and connect to portion 28 of the wet connection.

Returning now to FIG. 1 line 36 has a connection 38 above the packer 12. As shown in FIG. 3 connection 38 is preferably a weak link in line 36 and is preferably located between the packer 12 and the packer setting tool 24. It has segments 40 and 42 that break away when the string 26 is pulled up high enough, as shown in FIG. 3.

The coil 44 is optional and can be connected at 38 as shown in FIG. 1 or terminated elsewhere on the packer 12. At the other end it will run to the surface along the inner string 26. As another option it can be left out completely and the fiber optic string 36 can continue above the packer 12 without being wrapped around the inner string assembly 18 or otherwise placed against it in a manner to detect relative movement between the assembly 18 and the packer 12.

Those skilled in the art will recognize that the fiber optic line 36 located below packer 12 serves the purpose of monitoring the distribution of gravel during a gravel pack by sensing localized strain in a variety of locations and the coil 44 is there for the discrete purpose of sensing and communicating in real time the local relative movement of the inner string 18 with respect to the packer 12. The use of coil 44 is optional. Alternatively coil 44 may be used by itself while eliminating the fiber optic winding below the packer 12. When coil 44 is used by itself, it needs to only be secured to the packer 12, such as for example at a breakaway connection 38 while another end will be secured to the inner string assembly 18 and run up to the surface on the work string 26. When using coil 44 by itself the wet connection components 28 and 30 can be omitted. Of course, the disadvantage of only using the coil 44 to detect relative movement of assembly 18 with respect to the packer 12 is that there is no monitoring system about the screens during production in the form of a fiber optic line. That does not prevent other systems from being used to sense well conditions at the screens during production. However, those skilled in the art will appreciate that having both components, the fiber optic line around the screens 10 or a surrounding sleeve 37 and the coil 44 gives the flexibility to monitor the gravel pack in real time and to be sure the inner assembly 18 is properly positioned such as for reversing out by giving real time surface feedback of the actual movement downhole relative to the packer 12. The fiber line 36 goes in the hole connected through the packer 12 and has the capability to be reconnected after the connection 38 breaks to a fiber line 32 secured to the production string 34 by virtue of the wet connect components 28 and 30.

Those skilled in the art will appreciate that the various fiber optic lines can be inside a conduit to protect them from damage downhole. For example, the wet connect components 28 and 30 can couple two conduits that have flush mounted fiber optic cables that come together within the connected conduits. For the reason that a conduit may house the fiber line, the breakaway connection can have a seal in the conduit that surrounds the fiber line so that when the line is severed there is no leakage around the line that can get through the body of the packer 12.

While a spiral pattern has been illustrated as the preferred embodiment other configurations that allow gathering of the desired well data can be used. The fiber can extend primarily longitudinally in a sinusoidal wave pattern. It may be a more open or tightly packed spiral or circular pattern or the wraps can be adjacent to each other.

The wet connect can be of a type well known in the art. Its presence provides the ability to subsequently engage the fiber line after it is run into the well with the production string so that a single fiber line below the packer can serve multiple functions. Adding the coil 44 adds the ability to accurately position the inner assembly 18 without the guesswork and uncertainty of calculation of effects such as string weight or downhole temperature on the string which can be thousands of meters long being surface manipulated with the hope that a precise movement downhole occurs at the opposite end. Just as the windings or layout below packer 12 can be varied for the fiber line 36, those variations are also applicable to coil 44.

Coil 44 can be a tri-core shape sensing fiber with relative movement of the assembly 18 changing the shape and that shape change can be used to compute axial movement. Alternatively coil 44 can be a strain sensing fiber with the strain measured and translated to a linear movement of the assembly 18. Cable 36 can also be a tri-core shape sensing fiber that is wound on the screen 10 or the sleeve 37 in a wide variety of patterns and preferably a double helix pattern.

The above description is illustrative of the preferred embodiment and many modifications may be made by those skilled in the art without departing from the invention whose scope is to be determined from the literal and equivalent scope of the claims below.

We claim:

1. A subterranean completion assembly extending from a surface, comprising:

a screen assembly supported by a packer;

an inner string assembly extending through said packer and further comprising a setting tool for said packer and a crossover tool;

said inner string assembly movable into a plurality of positions with respect to said packer when said packer is set, one of said positions for use of said crossover to deliver gravel to a lower annulus outside said screens while taking returns to an upper annulus around said inner string assembly and above said packer;

at least one screen sensor disposed adjacent said screen and communicating to the surface at least one signal indicative of the distribution of gravel in said lower annulus in real time;

at least one inner string assembly sensor disposed in said upper annulus adjacent said packer and communicating to the surface at least one signal indicative of relative movement of said inner string assembly with respect to said set packer in real time;

said inner string assembly sensor comprises an inner string assembly fiber optic cable mounted above said packer;

said inner string assembly fiber optic cable is wound on said inner string assembly and is secured to it so that relative movement, of said inner string assembly with respect to said packer, creates stress that is sensed in said inner string assembly fiber optic cable and communicated to the surface.

2. The assembly of claim 1, wherein:

said screen sensor communicates to the surface selectively through at least a first and a second connections mounted adjacent said packer in said upper annulus.

3. The assembly of claim 2, wherein:

said first connection is assembled at the surface and is severed below the surface upon removal of said inner string assembly.

4. The assembly of claim 3, wherein:

said second connection comprises one part of a wet connection;

said completion assembly further comprising a production string with a mating component of said wet connection.

5. The assembly of claim 2, wherein:

said screen sensor comprises a screen fiber optic cable mounted to said screen assembly and extending to said connections above said packer.

6. The assembly of claim 5, wherein:

said inner string assembly fiber optic cable initially extends from the surface along said inner string assembly to a predetermined location designed to part under a tension force resulting from picking up said inner string assembly a predetermined distance.

7. The assembly of claim 5, wherein:

said screen assembly further comprises a surrounding sleeve and said screen fiber optic cable is mounted over said sleeve.

8. The assembly of claim 5, wherein:

said screen fiber optic cable is spirally wound around said screen.

9. The assembly of claim 8, wherein:

said screen fiber optic cable is in a double helix pattern around said screen with one end extending through said packer to a wet connection and an opposite end extending through said packer to a breakaway connection and continuing to the surface.

10. The assembly of claim 1, wherein:

said inner string assembly fiber optic cable is located inside a conduit that further comprises a breakaway connection;

said inner string assembly fiber optic cable is sealed in said conduit on opposed sides of said breakaway connection.

11. The assembly of claim 10, wherein:

said inner string assembly fiber optic cable breaks within said breakaway connection.

12. The assembly of claim 1, wherein:

said windings spread apart with said relative movement.

13. The assembly of claim 12, wherein:

said screen fiber optic cable having an end extending past said packer;

wherein said inner string assembly fiber optic cable comprises an extension of said screen fiber optic cable.

14. The assembly of claim 13, wherein:

said inner string assembly fiber optic cable comprises a breakaway connection designed to preferentially sever on application of a tensile force to said inner string assembly fiber optic cable during a predetermined relative movement of said inner string assembly with respect to said packer.

15. The assembly of claim 14, wherein:

said inner string assembly fiber optic cable is spirally wound around said inner string assembly.

16. The assembly of claim 1, wherein:

said inner string assembly fiber optic cable has an end connected to said packer and extends connected to said inner string assembly to the surface.

17. The assembly of claim 16, wherein:

said inner string assembly fiber optic cable comprises a breakaway connection designed to preferentially sever on application of a tensile force to said inner string assembly fiber optic cable during a predetermined relative movement of said inner string assembly with respect to said packer.

18. The assembly of claim 1, wherein:

said at least one inner string assembly sensor comprises an optical sensor.

* * * * *